US007931058B2

(12) United States Patent
Cruz

(10) Patent No.: US 7,931,058 B2
(45) Date of Patent: Apr. 26, 2011

(54) FLEXIBLE WORK TABLE TO MITER AND CUT MATERIALS

(75) Inventor: Felix Cruz, Montclair, NJ (US)

(73) Assignee: Felix Cruz, Montclair, NJ (US)

( * ) Notice: Subject to any disclaimer, the term of this patent is extended or adjusted under 35 U.S.C. 154(b) by 36 days.

(21) Appl. No.: 12/217,799

(22) Filed: Jul. 9, 2008

(65) Prior Publication Data

US 2010/0006011 A1 Jan. 14, 2010

(51) Int. Cl.

| | |
|---|---|
| ***B25H 1/02*** | (2006.01) |
| ***B25H 1/08*** | (2006.01) |
| ***B25H 1/10*** | (2006.01) |
| ***B25H 1/16*** | (2006.01) |

(52) U.S. Cl. ..... 144/286.5; 144/287

(58) Field of Classification Search ..... 144/285–287; 108/25, 147.21

See application file for complete search history.

(56) References Cited

U.S. PATENT DOCUMENTS

| | | | | |
|---|---|---|---|---|
| 5,431,206 | A * | 7/1995 | McAllister | 144/286.1 |
| 5,572,934 | A * | 11/1996 | Aldridge et al. | 108/25 |
| 5,592,884 | A * | 1/1997 | Glick et al. | 108/25 |
| 6,286,405 | B1 * | 9/2001 | Hamm | 83/781 |
| 7,252,125 | B2 * | 8/2007 | Haag | 144/286.5 |

* cited by examiner

*Primary Examiner* — Shelley Self

(57) ABSTRACT

A novel multi-purpose portable and flexible work table is presented herein. The work table can be used to secure material or workpiece to perform, at different heights, such actions as cutting, welding, soldering, gluing, painting, mitering, and shaping. The work table contains detachable sub-components that permit placing material or workpiece at specific positions to ensure that better tolerances and finishes of workpieces are created.

8 Claims, 9 Drawing Sheets

FLEXIBLE WORK TABLE TO MITER AND CUT MATERIALS

BACKGROUND OF THE INVENTION

1. Field of the Invention

This novel invention relates to a portable multi purpose work table. More in particular it addresses the make up of a unique flexible work table which can be used to rigidly secure material to perform such actions as shaping, cutting, welding, soldering, gluing, painting and mitering.

2. Description of Prior Art

Existing work tables are mainly of two types. Type I tables have a top rectangular surface which is supported by four rectangular legs which are connected together via cross bracing to provide lateral structural support. Type II tables have similar support legs as Type I and have a top surface section which is subdivided into two smaller sections. One of the sections is fixed in position and the other section is allowed, by the used of a spindle mechanism, to move toward or away from the fixed top section. This allows the work table to create a gap in the middle, between the two top sections, of the table which permits material to be locked in place between the two sections. One of the main deficiencies of existing work tables is that power tools cannot be used on the table to strip or miter material with any great accuracy. These tables do not have clamps as an integral part of the table configuration. In addition, the entire top surface of Type I & II tables are on the same elevation or there is no flat surface at the bottom of the top section.

The proposed novel invention presented herein will resolve many of the deficiencies associated with Type I and II tables. For instance workers will be able, with great ease, to rigidly secure materials to perform such actions as cutting, welding, soldering, gluing, painting, and mitering because of the integral clamps and adjustable parts of the table top.

BRIEF SUMMARY OF THE INVENTION

The novel invention presented herein, addressing the object of creating a portable work table with multiple sub-components and detachable sections of the top of the table to allow precise cutting, welding, soldering, gluing, painting, mitering and shaping of materials having different widths and heights. The top of the table has a section that is detachable and can be positioned at different heights. One of the novel features of the work table is manifested when the detachable section of the top of the table is removed and the horizontal trench which is between the two fixed top sections is exposed. The open horizontal trench area will allow work to be performed at angles and positions not possible with current state-of-the-art work tables.

DETAIL DESCRIPTION OF THE INVENTION

Figure 1:
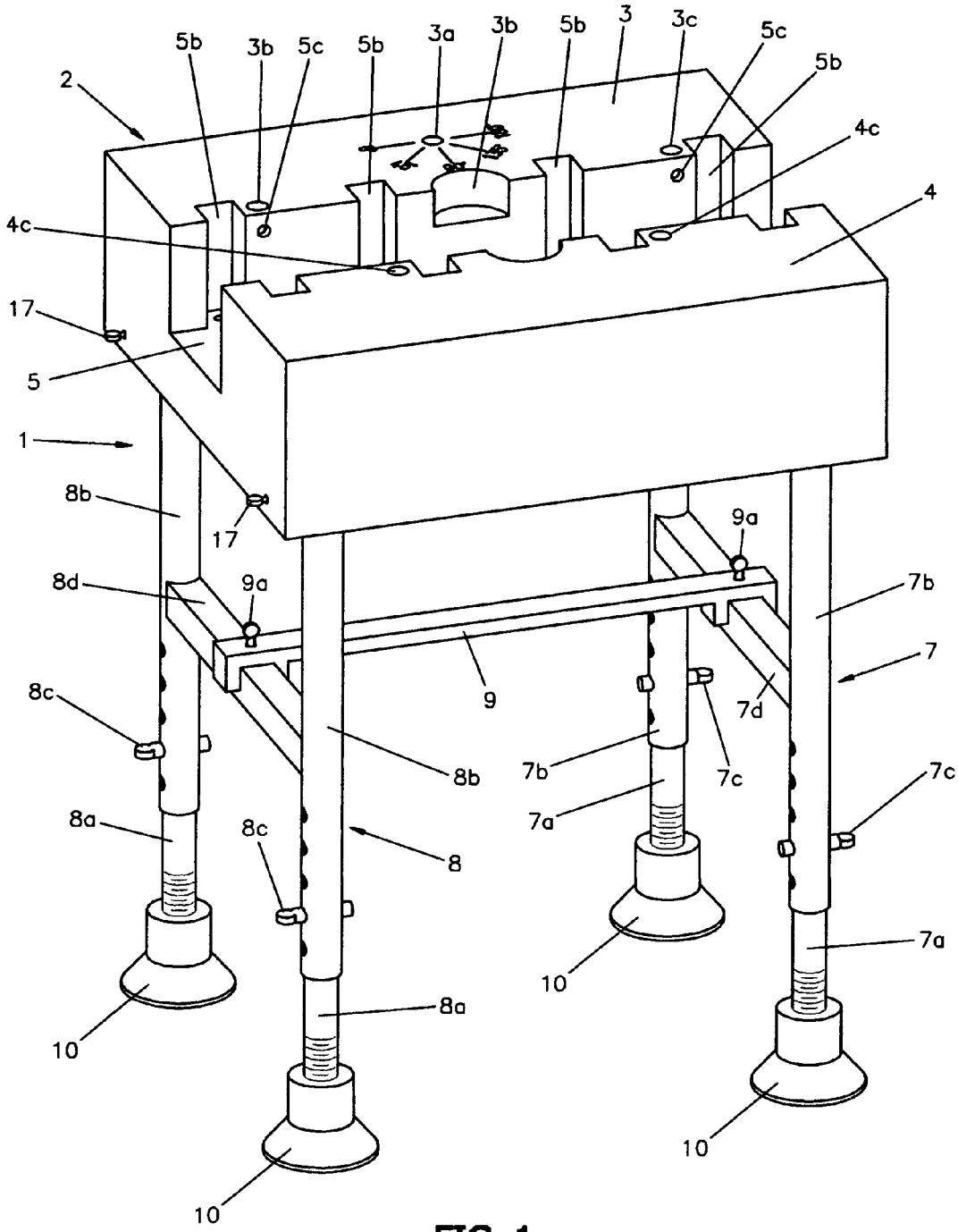
FIG. 1 shows an isometric view of the novel work table.

Referring now to FIG. 1 through FIG. 18 there is shown the novel portable work table 1. FIG. 1 shows the work table without any of its distinct and detachable sub-components. For instance the top section 2 which is comprised of two rectangular fixed sections 3 and 4 separated by a horizontal trench 5, and the opened curved surface 3*b* which divides the back top section 3 into symmetrical sections. The opened curved 3*b* also divides the horizontal trench area 5 into two sections wherein each section contains two vertical trenches 5*b*. Further, FIG. 1 and FIG. 2 also show holes 5*c* which are adjacent to vertical trenches 5*b* and are used to insert fasteners into holes 5*c* and inside side walls of horizontal trench 5. In addition, FIG. 1 shows the make up of the two identical H shaped structures 7 and 8, that support top section 2 of work table 1. The H shaped structure 8 is comprised of a top section 8*b*, a bottom section 8*a*, a cross beam 8*d*, a cup shaped sub-component 10 that is threaded to the bottom section 8*a*. There is also shown how the height of the top and bottom sections can be adjusted by changing the location of pin 8*c* and placing it in a different hole opening on the bottom of vertical member 8*b*. The two vertical members 8*b* both are attached to the bottom of the top section 2 by pin 17 (see also FIG. 3 and FIG. 4) which is inserted into holes on the sides of top section 2. The H shaped structure 7 is comprised of a top section 7*b*, a bottom section 7*a*, a cross beam 7*d*, a cup shaped sub-component 10 that is threaded to the bottom section 7*a*. There is also shown how the height of the top and bottom sections can be adjusted by changing the location of pin 7*c* and placing it in a different hole opening on the bottom of vertical member 7*b*. The two vertical members 7*b* both are attached to the bottom of the top section 2 by pin 17 (see also FIG. 3 and FIG. 4) which is inserted into holes on the sides of top section 2. FIG. 1 also shows the horizontal beam member 9 connecting the two identical H shaped structures 7 and 8 by inserting pin 9*a* into hole at both ends on top surface of horizontal beam 9 (see also FIG. 4). In addition, FIG. 1, FIG. 3, FIG. 4 and FIG. 11 also show pin 9*a* inserted from the top surface of horizontal beam 9 on the left and right section of horizontal beam 9 to connect horizontal beam 9 to the two H shaped structure 7 and 8.

Figure 2:
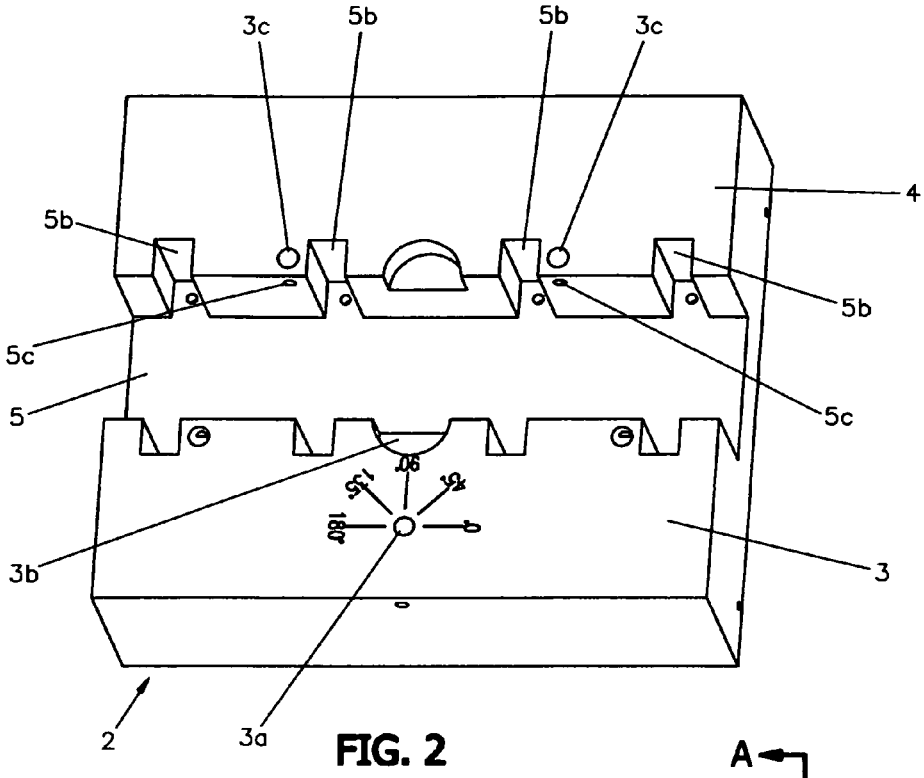
FIG. 2 shows an isometric view of only the top section of the novel work table.
Figure 3:
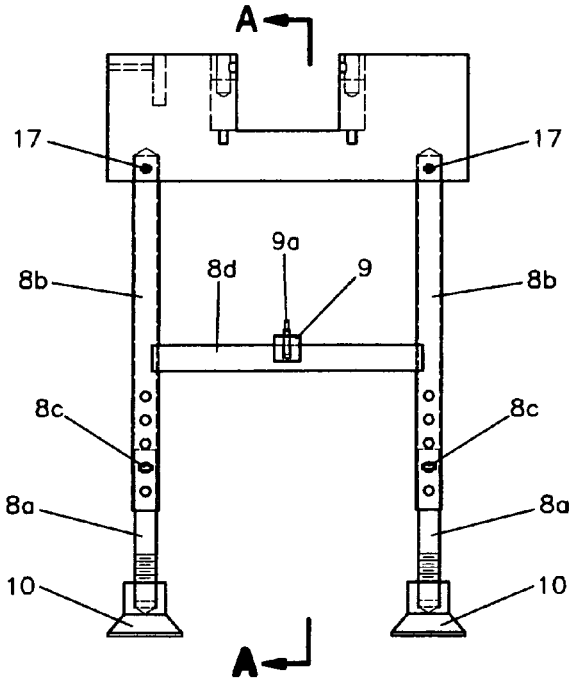
FIG. 3 shows an elevation view of the novel work table.
Figure 4:
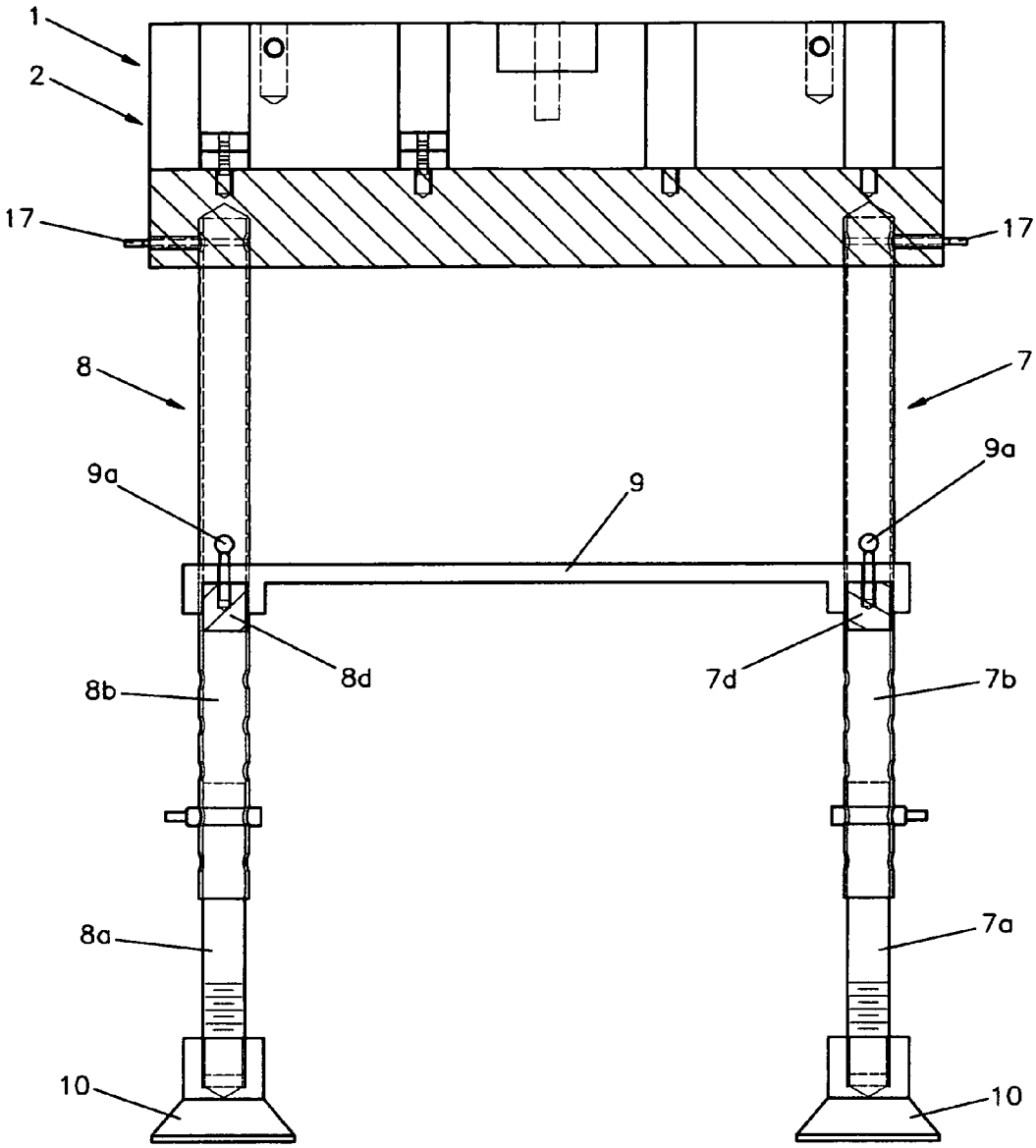
FIG. 4 shows cut section A-A shown in FIG. 3.
Figure 5:
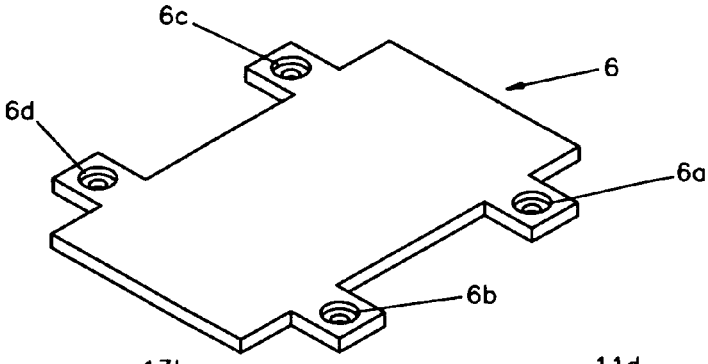
FIG. 5 shows an isometric view of the detachable table top.
Figure 11:
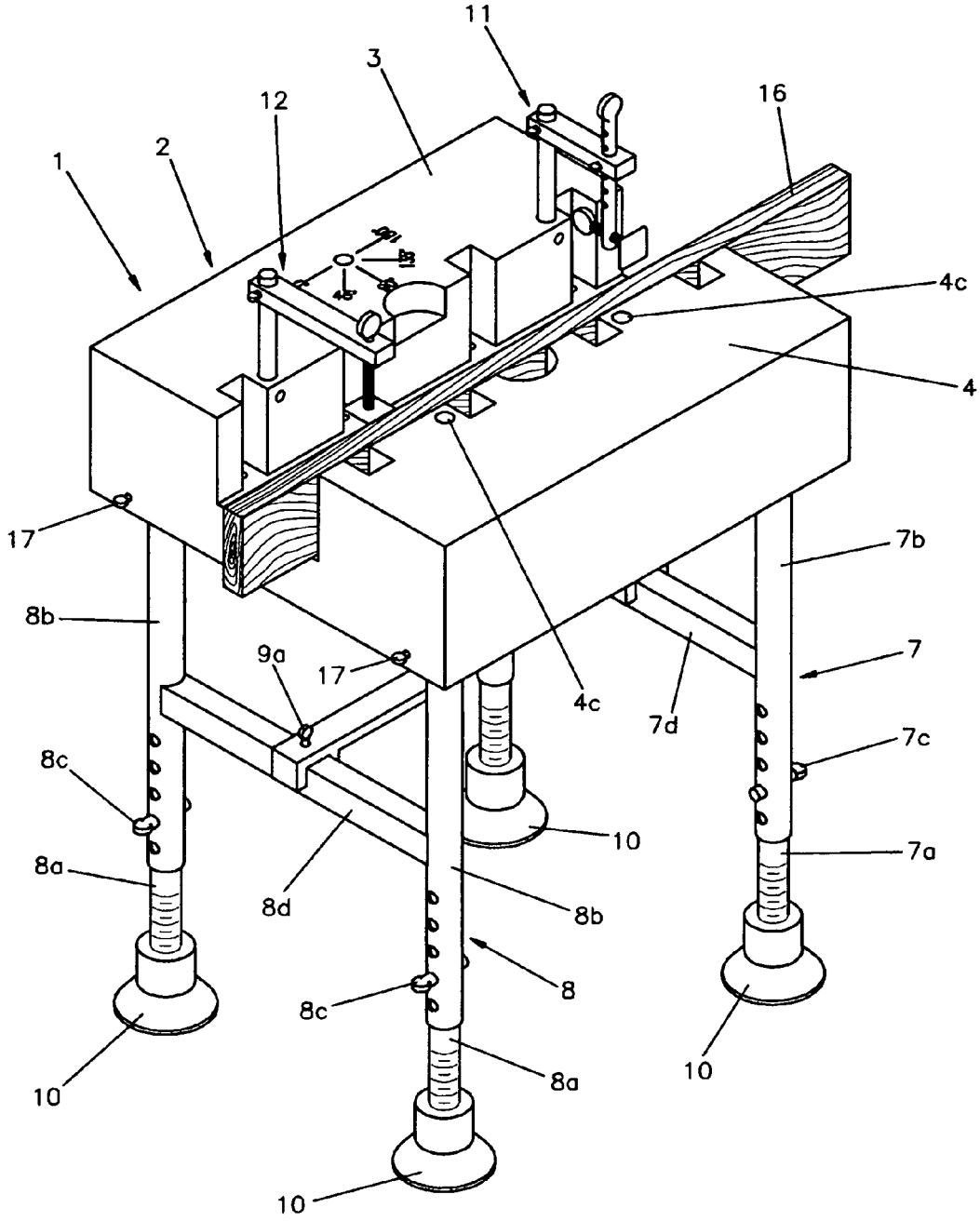
FIG. 11 shows an isometric view of work table, a wooden beam, and the 3D and 5D clamp units.
Figure 12:
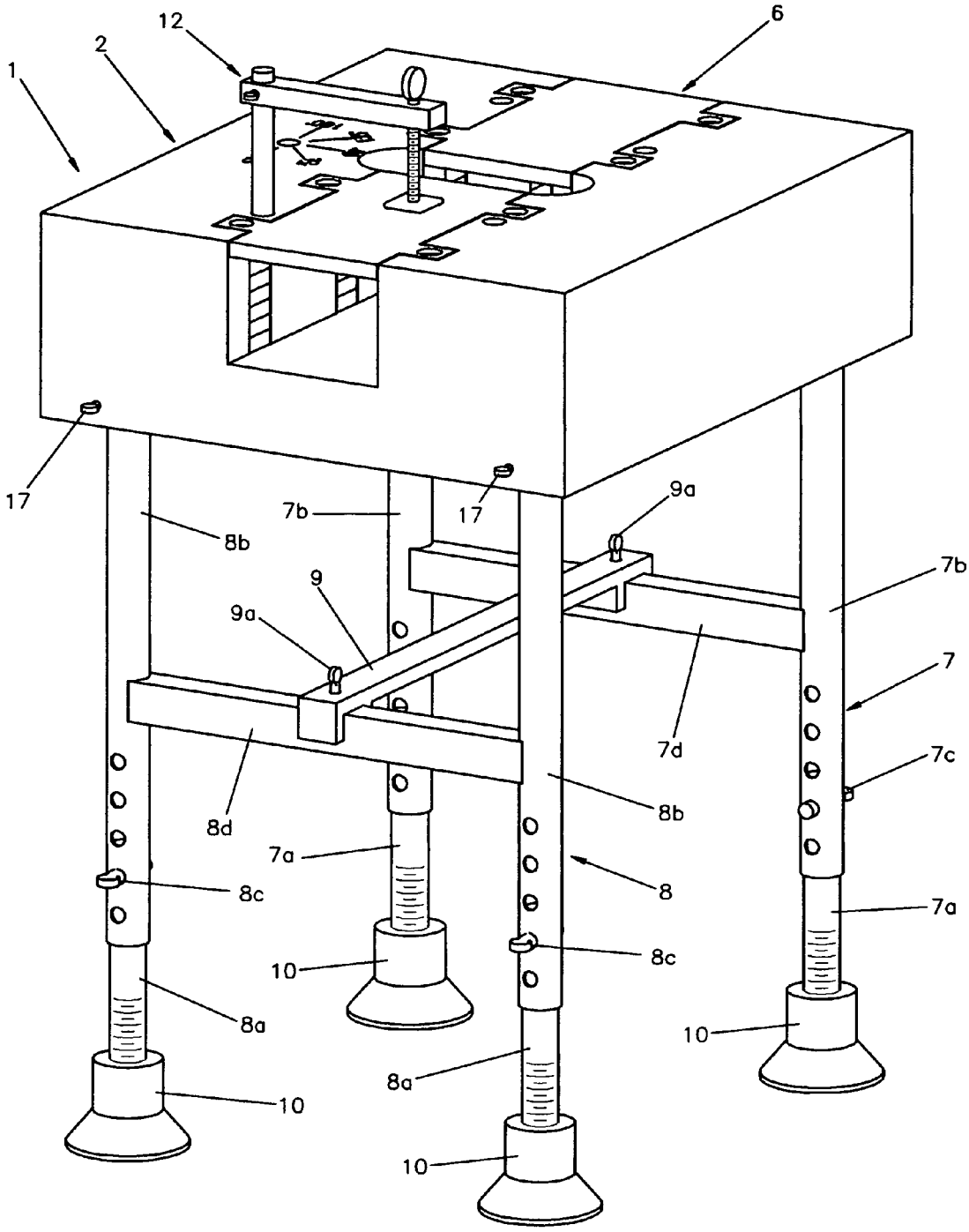
FIG. 12 shows an isometric view of work table, two detachable table top, and 3D clamp unit.

There is also shown in FIG. 2 and FIG. 11 the top section 2 of work table 1 with multiple holes 3*c*, 3*a*, and 4*c* on the top surface 3. The vertical trenches 5*b* are shown in FIG. 2 with out the any of the vertical stud blocks 15 (FIG. 8) installed and with out the detachable table top 6 (FIG. 5 and FIG. 12). FIG. 4 shows how the separate parts of the novel work table are connected together using pins 17, 9*a* and threaded vertical member 8*a* and 7*a* into cup shape sub-component 10.

Note: The following three paragraphs are being added/amended.

Figure 6:
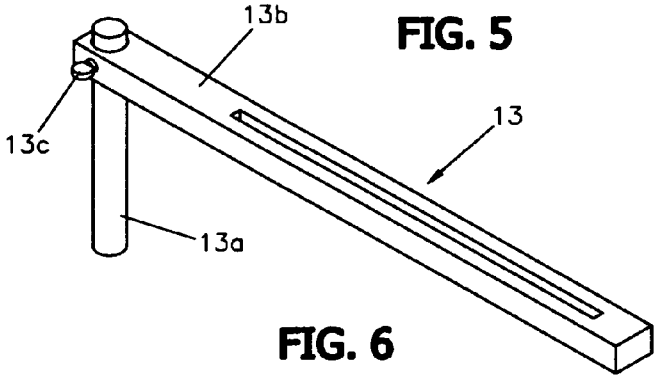
FIG. 6 shows an isometric view of the flexible miter unit.
Figure 9:
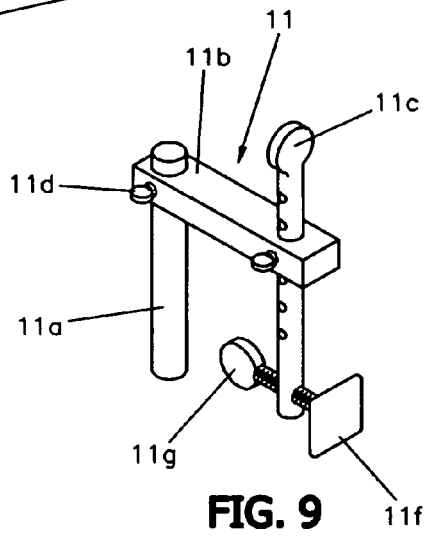
FIG. 9 shows an isometric view of the 5D clamp unit.
Figure 13:
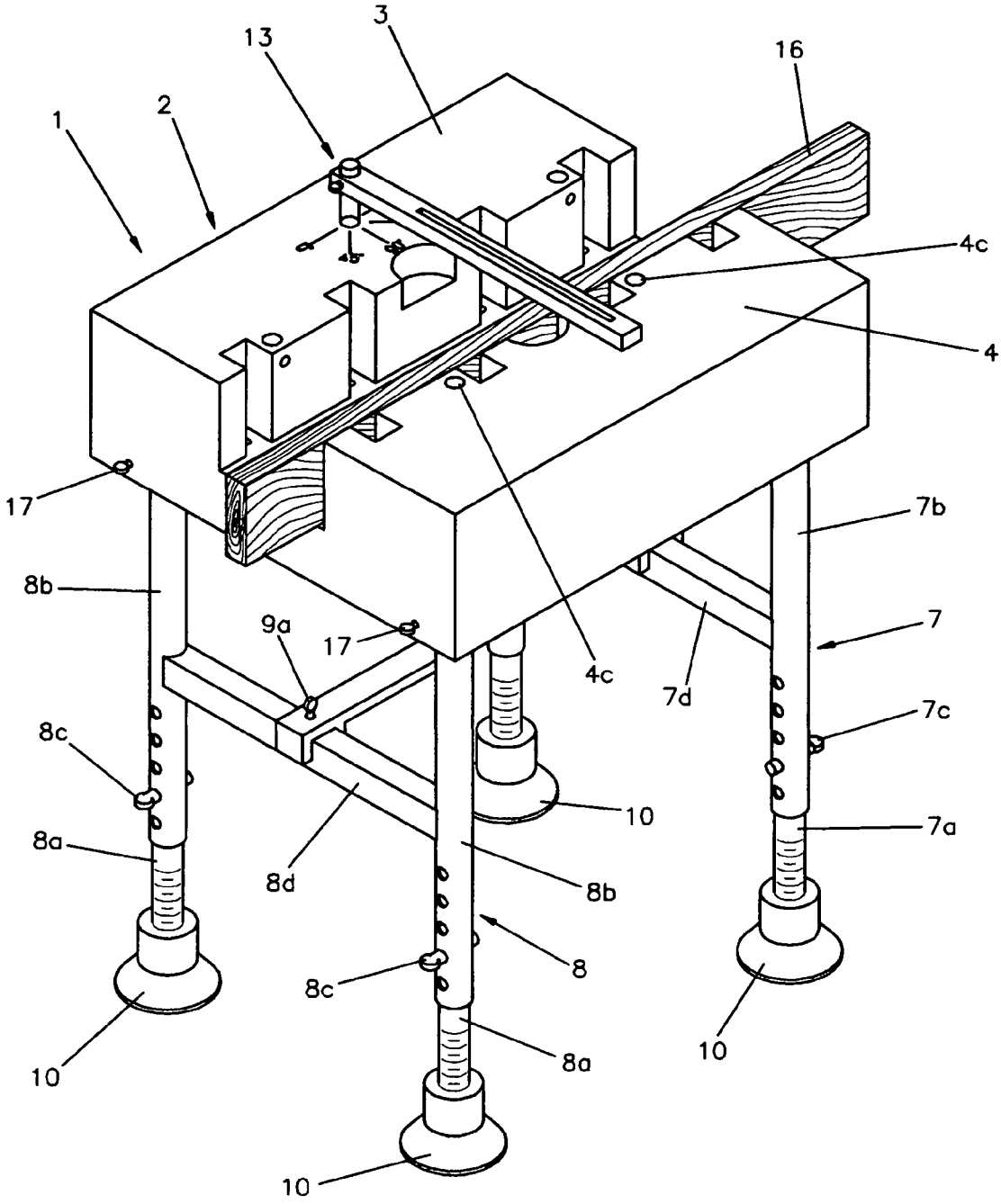
FIG. 13 shows an isometric view of work table, a wooden beam, and flexible miter unit.
Figure 14:
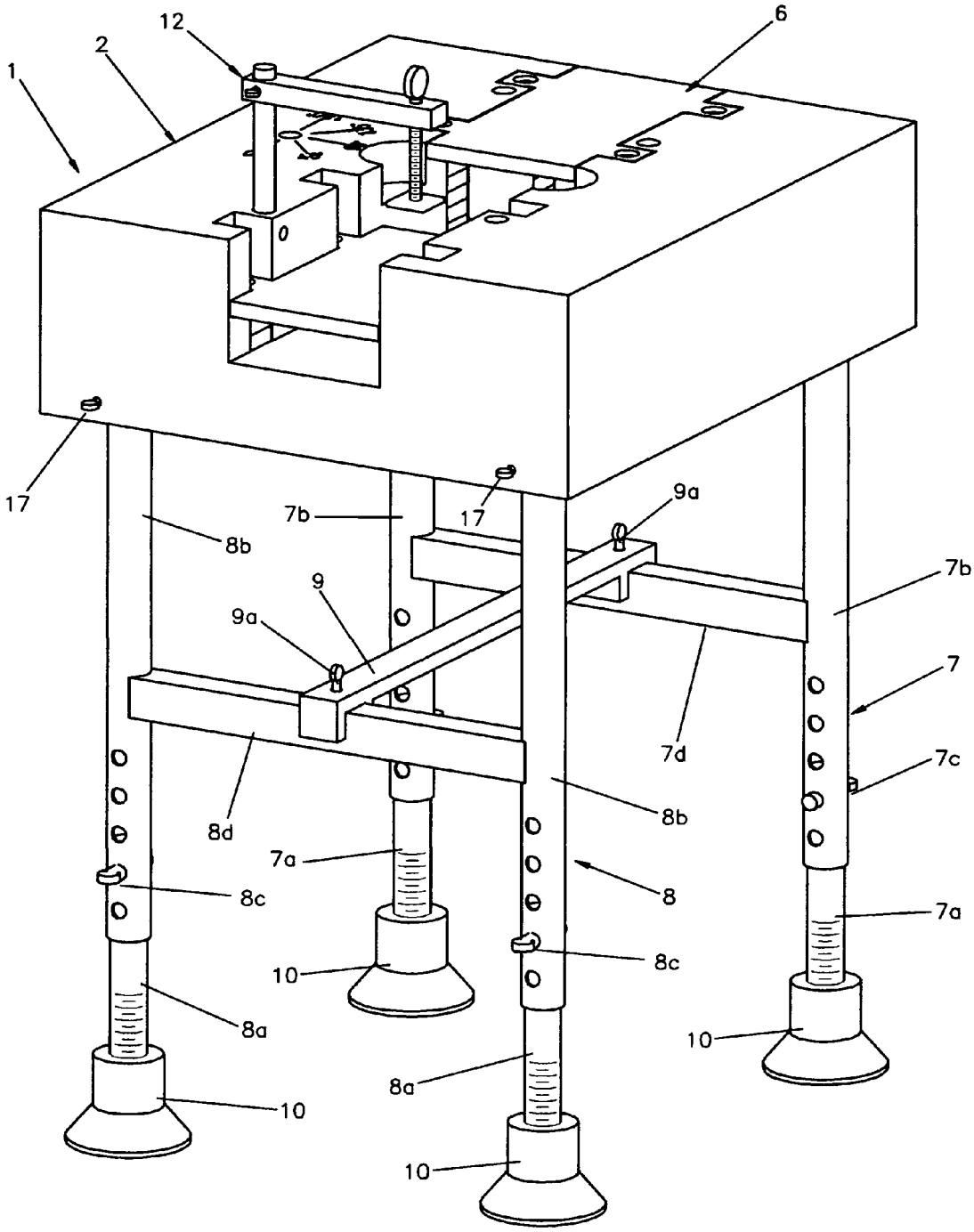
FIG. 14 shows an isometric view of work table and two detachable table top.
Figure 15:
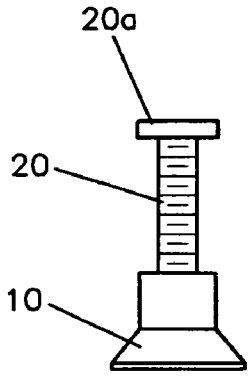
FIG. 15 shows an isometric view of the vertical support unit.
Figure 16:
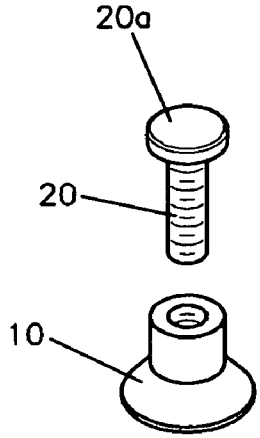
FIG. 16 shows a second isometric view of the vertical support unit.
Figure 17:
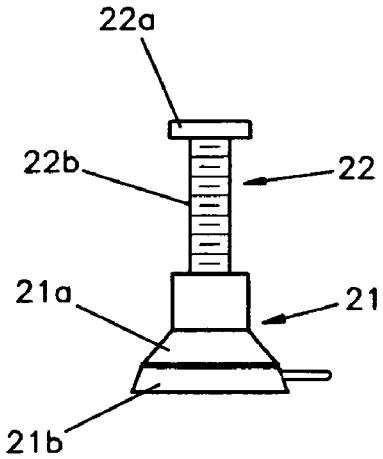
FIG. 17 shows an isometric view of the vertical support unit with a vacuum base.
Figure 18:
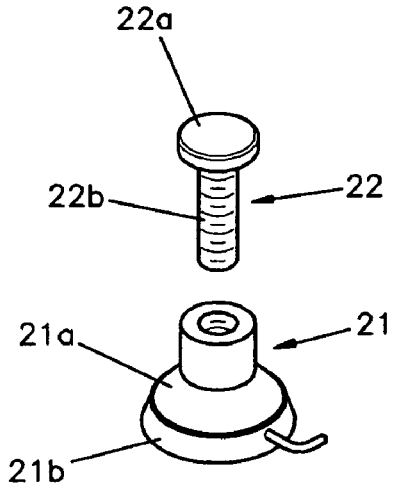
FIG. 18 shows a second isometric view of the vertical support unit with a vacuum base separated from threaded screw with a top face plate.

Furthermore, FIG. 5 shows the detachable table top 6 with four rectangular blocks 6*a*, 6*b*, 6*c*, and 6*d* on its outer perimeter. FIG. 12 and FIG. 14 illustrates how the rectangular blocks of detachable table top 6 are inserted inside the vertical trenches 5*b* (FIG. 1 and FIG. 2) of work table 1 in order to attached the detachable table top 6 to work table 1. FIG. 6 also identifies a flexible miter unit 13 that is installed on work table 1 by inserting vertical cylinder 13*a* into any of the holes 3*a*, 3*b*, 4*c*, 3*c* (FIG. 1 and FIG. 2). FIG. 13 shows the flexible miter unit 13 installed in work table 1 and a work piece position inside horizontal trench 5 and flexible miter unit 13 resting on top of the work piece. To cut the working piece a cutting tool (not shown in FIG. 13) can be inserted inside the slotted groove of flexible miter unit and moved back and forth to cut the work piece.

Figure 7:
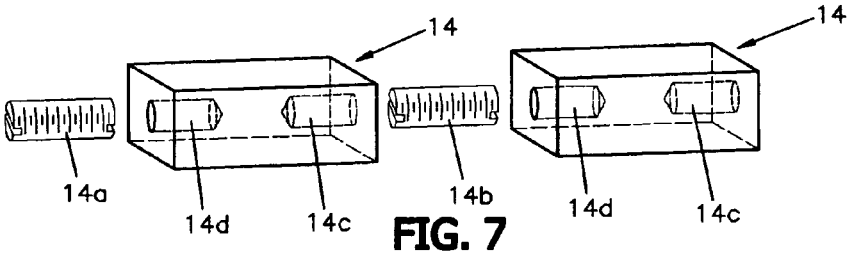
FIG. 7 shows an isometric view of the horizontal-stud block.
Figure 8:
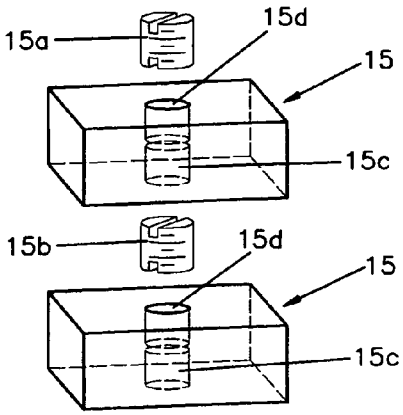
FIG. 8 shows an isometric view of the vertical-stud block.
Figure 10:
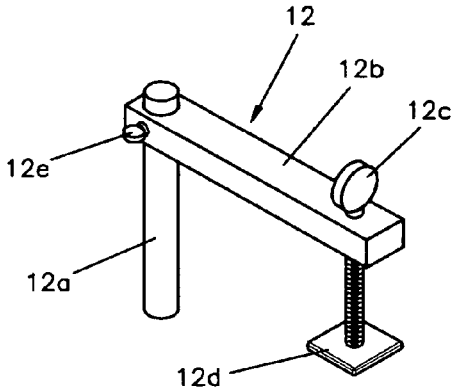
FIG. 10 shows an isometric view of the 3D clamp unit.

In addition, FIG. 7 shows horizontal stud block 14 which comprises of two rectangular cubes connected by a threaded stud. The horizontal stud block 14 are used to secure a work piece (FIG. 11) that is placed against one of the side walls of the horizontal trench 5 (FIG. 1 and FIG. 2). FIG. 11 does not show the placement of the horizontal stud blocks. FIG. 8 shows vertical stud block 15 which comprises of two rectangular blocks connected by a threaded stud. The vertical stud blocks 15 are inserted inside the vertical trenches 5*b* (FIG. 1 and FIG. 2) to change the vertical location of where the detachable table tops 6 can be placed on work table 1 (FIG. 12 and FIG. 14). The vertical position of the table top 6 is determined by the amount of vertical stud blocks that are inserted inside vertical trenches 5*b*. FIG. 14 shows one detachable table top 6 positioned at a lower elevation than a second detachable table top 6, that is positioned at a much higher elevation. This allows for a 3-D clamp 12 (FIG. 14.) to be used on the side of work table 1 that has the detachable table top at the lower elevation.

The novel invention also contains unique clamps 12, 11 (FIG. 9 and FIG. 11) to secure work pieces to work table 1. For instance FIG. 11 shows one 3-D and one 5-D clamp unit, 12 and 11, installed on work table 1 and each of the clamps' face plate 12*d* and 11*f* (FIG. 9 and FIG. 10) pressing on, or very close to the work piece that is shown in FIG. 11. Once a work a piece is secure and will not move a cutting tool can be used to cut, sand, or shape the surface of the work piece.

FIGS. 15, 16, 17, and 18 show different views of the cup shaped detachable, the vertical support unit, sub-components. The vertical support unit which is comprised of parts 20, 20*a*, and 10 and the vacuum based vertical support unit 22, which are used in trench area 5 (FIG. 1 and FIG. 2) to adjust the final vertical height of where the work piece will be placed before it is cut or worked on. For example Threaded screw 20 is rotated until the required height is reached and then a work piece to be worked is placed on top of face plate 20*a*. Note FIG. 15 does not show the work piece on top of vertical support unit. The height of vacuum base vertical support unit 22 is adjusted in the same manner. Once the proper height has been determined the lever on vacuum base 21*b* is twisted downward to adhere the base 21*b* to a floor or other type of surface in order to prevent it from moving. Then, the work piece to be worked on can be placed on top of the face plate 22*a*.

I claim:

1. A main work table, with detachable distinct sub-components, said work table comprising a top section divided by a horizontal trench into identical front and back sections; said top section of said work table being supported by four vertical members, each vertical member having external threads on a bottom section of said vertical members and four cup-shaped sub-components containing internal threads; said cup-shaped sub-components are threaded into said bottom section of each of said vertical members; said work table further comprising: said top section containing multiple holes on a surface of said top section, in which said top front and back sections are divided in half by a curved vertical trench; said horizontal trench having a bottom surface and two side walls, wherein each said side wall is symmetrical, each said side wall containing four vertical trenches; and said top section further comprising a set of said sub-components comprising a horizontal-stud block, vertical stud block, flexible miter-unit, 5D clamp unit, 3D clamp unit, vacuum support unit and detachable table top; wherein at least one of said set of sub-components is usable in said top section of said work table.

2. A work table according to claim 1, wherein said horizontal stud block comprises two rectangular cubes and each said cube having bores on a left and right side of each rectangular cube; said bores containing inner threads; wherein one end of a threaded stud is partially screwed into one of said bores of said rectangular cube and the other end of said threaded stud is screwed into the other bore of the other said rectangular cube; and wherein one end of said horizontal stud block is inserted into one of said four vertical trenches on one of said side walls of said horizontal trench in order to secure a workpiece to the other said side wall of said horizontal trench.

3. A work table according to claim 1, wherein said vertical stud block comprises two rectangular cubes and each said rectangular cube having bores on top and bottom sides of each said rectangular cubes, said bores containing inner threads; wherein one end of a threaded stud is partially screwed into the top surface of one of said rectangular cubes and the other end of said threaded stud is screwed into the bottom surface of said other rectangular cube; and wherein one end of said vertical stud block is inserted into one of said four vertical trenches on one of said side walls in order to establish different heights about which to place said detachable table top.

4. A work table according to claim 1, wherein said detachable table top comprises a rectangular structure having four outwardly protruding blocks, said rectangular structure having said two blocks protruding outward from one side, side one, of said rectangular structure, said rectangular structure further having the other said two blocks protruding outward on a second side, side two, of said rectangular structure and said side two is a side of said rectangular structure that is opposite said side one; wherein said four blocks attached to said detachable table top are placed inside said four vertical trenches of said two side walls of said horizontal trench.

5. A work table according to claim 1, wherein said flexible miter unit comprises a rectangular structure and vertical cylinder, said rectangular structure having a thin longitudinal hole at center of said rectangular structure, said rectangular structure further containing a circular hole on the left of said longitudinal hole of said rectangular structure and said vertical cylinder is inserted through said circular hole; wherein the bottom end of said vertical cylinder is inserted in one of said multiple holes of the surface of said top section.

6. A work table according to claim 1, wherein said vacuum support unit comprises a solid cup-shaped structure, vacuum mount, and vertical screw; said cup-shaped structure having a bore on the top surface of said cup-shaped structure, said bore containing inner threads; said vertical screw having flat edge on the top end of said vertical screw and the bottom end of said vertical screw is partially threaded into said bore; said vacuum mount is attached to the bottom surface of said cup-shaped structure and said vacuum mount having a lever protruding outward from the outer surface of said vacuum mount; wherein said vacuum support unit is placed on said bottom surface of said horizontal trench and said lever is rotated to created a suction force to temporary adhere said vertical support unit to said bottom surface of said horizontal trench.

7. A work table according to claim 1, wherein said 3D clamp comprises a main horizontal structure, vertical cylinder, and vertical screw; said main horizontal structure having a hole on the left end of said main horizontal structure, said main horizontal structure further containing a second hole on the right side of said horizontal structure, said second hole having inner threads; said vertical cylinder is inserted inside said hole on the left end of said main horizontal structure, said vertical screw is threaded inside said second hole, said vertical screw further having a flat edge on the bottom end of said vertical screw; wherein the bottom end of said vertical cylinder is inserted in one of said multiple holes of the surface of said top section.

8. A work table according to claim 1, wherein said 5D clamp comprises a main horizontal structure, vertical cylinder, horizontal screw, and vertical screw; said main structure having a hole on the left end of said main horizontal structure, said main horizontal structure further containing a second hole on the right side of said horizontal structure, said second hole having inner threads; said vertical cylinder is inserted inside said hole on the left end of said main horizontal structure, said vertical screw is threaded inside said second hole; said vertical screw having a flat edge plate at the bottom end of said vertical screw; said flat edge plate having a hole at center of said flat edge plate, said hole of said flat edge plate containing inner threads; said horizontal screw is threaded inside said hole of said flat edge plate and said horizontal screw further having a flat edge on the left end of said horizontal screw; wherein the bottom end of said vertical cylinder is inserted in one of said multiple holes of the surface of said top section.

* * * * *